US006227846B1

(12) United States Patent
Zagoroff

(10) Patent No.: US 6,227,846 B1
(45) Date of Patent: May 8, 2001

(54) HEAT GUN WITH HIGH PERFORMANCE JET PUMP AND QUICK CHANGE ATTACHMENTS

(75) Inventor: Dimiter S. Zagoroff, Lincoln, MA (US)

(73) Assignees: Shrinkfast Corporation, Chelsea; Battenfeld Gloucester Engineering Co., Inc., Gloucester, both of MA (US)

( * ) Notice: Subject to any disclaimer, the term of this patent is extended or adjusted under 35 U.S.C. 154(b) by 0 days.

(21) Appl. No.: 09/452,011

(22) Filed: Nov. 30, 1999

Related U.S. Application Data

(63) Continuation-in-part of application No. 08/966,293, filed on Nov. 7, 1997, now Pat. No. 6,010,329

(60) Provisional application No. 60/030,770, filed on Nov. 8, 1996.

(51) Int. Cl.[7] ..... F23D 14/46

(52) U.S. Cl. ..... 431/345; 431/264

(58) Field of Search ..... 431/345, 344, 431/264, 265, 255; 174/47; 285/319; 34/97

(56) References Cited

U.S. PATENT DOCUMENTS

| | | | |
|---|---|---|---|
| Re. 28,665 | 12/1975 | Zagoroff | 431/347 |
| 1,449,504 | 3/1923 | Ehrhart | 417/163 |
| 1,543,834 | 6/1925 | Ehrhart | 417/163 |
| 1,549,353 | 8/1925 | Ehrhart . | |
| 2,000,762 | 5/1935 | Kraft . | |
| 2,072,599 | 3/1937 | Lemaitre | 417/163 |
| 2,111,266 | 3/1938 | Hopkins . | |
| 2,114,494 | 4/1938 | Hummel et al. | 21/2 |
| 2,238,806 | 4/1941 | Doubledent | 158/76 |
| 2,414,459 | 1/1947 | Fletcher | 158/1.5 |
| 2,639,580 | 5/1953 | Stuart | 60/35.6 |
| 2,748,753 | 6/1956 | Sarrazin et al. | 122/24 |
| 2,750,733 | 6/1956 | Paris et al. | 60/35.6 |
| 2,807,316 | 9/1957 | Jackson | 158/4 |
| 2,907,382 | 10/1959 | McIlvaine | 158/4 |
| 3,163,707 * | 12/1964 | Darling | 174/47 |
| 3,204,862 | 9/1965 | Hadeler | 230/95 |
| 3,371,188 | 2/1968 | Henes et al. | 219/373 |
| 3,436,164 * | 4/1969 | Deucher | 431/255 |
| 3,452,933 | 7/1969 | Hakluytt | 239/399 |
| 3,550,721 | 12/1970 | Bruner | 181/51 |
| 3,583,831 | 6/1971 | Hoggarth | 417/161 |

(List continued on next page.)

FOREIGN PATENT DOCUMENTS

| | | |
|---|---|---|
| 398 472 | 12/1994 | (AU) . |
| 298 314 | 7/1954 | (CH) . |
| 2 095 661 | 2/1972 | (FR) . |
| 2 520 090 | 7/1983 | (FR) . |
| 2 030 280 | 4/1980 | (GB) . |

OTHER PUBLICATIONS

Kline, S.J., "On the Nature of Stall," *Journal of Basic Engineering*, pp. 305–320 (Sep. 1959).

*Primary Examiner*—Ira S. Lazarus
*Assistant Examiner*—David Lee
(74) *Attorney, Agent, or Firm*—Hamilton, Brook, Smith & Reynolds, PC

(57) ABSTRACT

A combustor extension for a heat gun where the heat gun has a jet pump for mixing pressurized fuel with air to form an air/fuel mixture and a combustor attachment for combusting the air/fuel mixture. The jet pump has a first electrical connector for providing an electrical charge to an ignition device at the combustor attachment for igniting the air/fuel mixture. The combustor extension includes a hollow conduit having proximal and distal ends for extending between and coupling the combustor attachment to the jet pump. A second electrical connector at the proximal end of the conduit electrically couples to the first electrical connector of the jet pump. A third electrical connector at the distal end of the conduit electrically couples to the ignition device of the combustor attachment. The second and third electrical connectors are electrically connected together.

18 Claims, 15 Drawing Sheets

U.S. PATENT DOCUMENTS

| | | | | |
|---|---|---|---|---|
| 3,589,612 | | 6/1971 | Shaffer | 239/139 |
| 3,612,037 | * | 10/1971 | Spiggle | 431/344 |
| 3,663,154 | | 5/1972 | Locke | 431/353 |
| 3,710,890 | | 1/1973 | True et al. | 181/33 HC |
| 3,873,029 | | 3/1975 | Mihaly | 239/518 |
| 3,917,442 | | 11/1975 | Zagoroff | 431/351 |
| 3,923,448 | | 12/1975 | Guth | 431/354 |
| 4,002,297 | | 1/1977 | Pillard | 239/429 |
| 4,013,395 | | 3/1977 | Wormser | 431/9 |
| 4,018,493 | * | 4/1977 | Lyman et al. | 439/195 |
| 4,067,686 | | 1/1978 | Karpisek | 431/353 |
| 4,079,965 | * | 3/1978 | Moughty et al. | 174/47 |
| 4,162,370 | * | 7/1979 | Dunn et al. | 174/47 |
| 4,215,384 | * | 7/1980 | Elson | 174/47 |
| 4,216,652 | | 8/1980 | Herman et al. | 60/748 |
| 4,274,812 | | 6/1981 | Elvidge et al. | 417/179 |
| 4,277,640 | * | 7/1981 | Kutnyak et al. | 174/47 |
| 4,355,949 | | 10/1982 | Bailey | 415/35 |
| 4,383,820 | * | 5/1983 | Camacho | 431/265 |
| 4,400,138 | | 8/1983 | Baer | 417/179 |
| 4,419,074 | | 12/1983 | Schuetz | 431/354 |
| 4,431,240 | * | 2/1984 | Riehl | 431/264 |
| 4,433,266 | * | 2/1984 | Riehl | 431/264 |
| 4,462,649 | * | 7/1984 | Medford et al. | 174/47 |
| 4,487,553 | | 12/1984 | Nagata | 417/171 |
| 4,494,270 | * | 1/1985 | Ritzau et al. | 174/47 |
| 4,521,666 | | 6/1985 | Severance, Jr. et al. | 217/121 PY |
| 4,553,927 | * | 11/1985 | Collins, Jr. | 431/264 |
| 4,592,204 | | 6/1986 | Rice | 60/39.161 |
| 4,598,871 | | 7/1986 | Hartle | 239/706 |
| 4,699,587 | | 10/1987 | Shimoda et al. | 431/354 |
| 4,702,420 | | 10/1987 | Rath | 239/391 |
| 4,744,748 | | 5/1988 | Raines et al. | 431/353 |
| 4,861,962 | | 8/1989 | Sander et al. | 219/121.5 |
| 4,866,565 | * | 9/1989 | Wray, Jr. | 174/47 |
| 4,877,371 | | 10/1989 | Putt | 415/169.1 |
| 4,886,447 | | 12/1989 | Goss | 431/353 |
| 4,932,686 | * | 6/1990 | Anderson, Jr. | 285/24 |
| 4,969,814 | | 11/1990 | Ho et al. | 431/8 |
| 4,993,756 | * | 2/1991 | Bechu | 285/319 |
| 4,996,972 | | 3/1991 | Poston | 126/263 |
| 5,044,445 | * | 9/1991 | Kayahara | 174/47 |
| 5,054,106 | * | 10/1991 | Fortune | 174/47 |
| 5,056,720 | | 10/1991 | Crum et al. | 239/698 |
| 5,057,008 | | 10/1991 | Dielissen | 431/351 |
| 5,074,802 | * | 12/1991 | Gratziani et al. | 439/192 |
| 5,135,387 | | 8/1992 | Martin et al. | 431/116 |
| 5,156,002 | | 10/1992 | Mowill | 60/738 |
| 5,170,942 | | 12/1992 | Spink et al. | 239/427.3 |
| 5,203,474 | | 4/1993 | Haynes | 222/129 |
| 5,271,564 | | 12/1993 | Smith | 239/532 |
| 5,285,008 | * | 2/1994 | Sas-Jaworsky et al. | 174/47 |
| 5,337,728 | | 8/1994 | Maruyama | 126/344 |
| 5,368,230 | | 11/1994 | Oppenberg | 239/132.5 |
| 5,372,312 | | 12/1994 | Vidusek | 239/419.3 |
| 5,395,046 | | 3/1995 | Knobbe et al. | 239/3 |
| 5,464,344 | | 11/1995 | Hufton | 431/10 |
| 5,520,334 | | 5/1996 | White | 239/85 |
| 5,551,635 | | 9/1996 | Jäger | 239/240 |
| 5,558,276 | | 9/1996 | Barrett et al. | 239/135 |
| 5,592,749 | * | 1/1997 | Trimmer | 34/97 |
| 5,740,583 | * | 4/1998 | Shimada et al. | 15/377 |
| 5,799,834 | * | 9/1998 | Small et al. | 222/148 |

* cited by examiner

HEAT GUN WITH HIGH PERFORMANCE JET PUMP AND QUICK CHANGE ATTACHMENTS

RELATED APPLICATION

This application is a continuation-in-Part of U.S. Ser. No. 08/966,293 filed Nov. 7, 1997 now U.S. Pat. No. 6,010,329, which claims the benefit of U.S. Provisional Application No. 60/030,770 filed on Nov. 8, 1996, the entire teachings of which are incorporated herein by reference.

BACKGROUND OF THE INVENTION

The effectiveness of heat guns is predicated upon the ability of the combustion products to entrain and propel vast amounts of the surrounding air. Two factors have been found to enhance this process: 1) The speed of the combustion products to be as high as possible and 2) the combustor outlet to be in the shape of a slot in order to maximize the gas/air interface and create a fan shaped heat output pattern.

The speed of the combustion products is a function of the pressure recovery of the jet pump which is used to aspirate the combustion air by the expansion of the gaseous fuel. The performance of the jet pump is thus linked directly with the effectiveness of the heat gun.

One measure to improve the performance of prior art jet pumps has been to lengthen the diffusor to achieve maximum pressure recovery. One drawback of pushing the diffusor to its limits is the attendant tendency for flow separation and pressure fluctuation. The periodic flow separation occurs spontaneously, even in a perfectly draft-free room, but are exacerbated by any disturbance: by moving the heat gun about, by air drafts and even by sound. The result is an uneven flow, noisy combustion, bad emissions and performance fluctuations.

Another measure to improve the performance of prior art jet pumps has been to use multiple nozzles in place of a single nozzle. These efforts have aimed to arrange the nozzles to shorten the mixing process and minimize friction losses in the mixing duct of the jet pump.

The fan shaped pattern has the advantage of spreading the heat evenly over a wide area. The heated area is a long, narrow zone in line with the combustor slot which the operator sweeps over the object to cover the whole area.

The orientation of the slot relative to the handle of the heat gun is usually a matter of personal preference but in some instances also of practical significance. When shrinking a plastic bag over a pallet for instance, it is important to first shrink the bottom of the bag all around to prevent it from riding up. A horizontal orientation of the slot is most efficient for this operation. Subsequently, when shrinking the sides of the bag, a vertical orientation is more effective. Thus it is desirable to change the orientation of the slot easily and quickly.

One commercially available heat gun employs a screw with a wing head to fasten the cylindrical combustor inlet to the body of the heat gun so that the operator can adjust its orientation without tools. This arrangement however is awkward in practice since the mounting screw has to be loosened and tightened every time the slot orientation is changed. If the operator neglects to tighten the screw, he runs the risk of losing it.

Another need that arises in practice is to extend the length of the heat gun to heat objects which are out of reach. This situation occurs for instance when shrink wrapping tall pallet loads or big boats. In the past this has been accomplished by extension tubes. The extension tube ducts the combustible mixture from the jet pump to the combustor as well as providing an electrical lead and ground from the ignitor to the spark plug. The installation is particularly cumbersome. First the fasteners holding the combustor have to be removed, the spark plug lead disconnected and the combustor taken off. Then the process has to be repeated twice in the reverse order, once to attach the extension to the gun, and again to mount the combustor to the extension. Disassembly is an equally complicated process. An added problem arises in keeping the second set of fasteners from getting lost.

A serious ignition problem arises with the extension if the ignition lead is carried inside the extension tube. After operating the gun a few times the spark grows progressively weaker until it is unable to light off the gun. The only solution to this problem in the past has been to mount the ignition lead outside the extension tube. This arrangement is costly and makes the ignition lead vulnerable to damage in use.

SUMMARY OF THE INVENTION

The present invention is directed to a jet pump for a heat gun including an elongate hollow pump body lying along a longitudinal axis. The pump body has an inlet, a mixing section and an outlet. A nozzle unit is axially aligned with the inlet for directing pressurized fuel into the inlet of the pump body. Movement of the pressurized fuel into the inlet causes air to be drawn into the inlet to mix with the fuel within the pump body. A disk shaped air diverter is axially spaced away from the inlet of the pump body. The diverter has a length and a diameter. The diameter of the diverter is greater than the length of the diverter and larger than the inlet of the pump body. A housing is radially spaced from and surrounds the diverter forming a first annular gap therearound for air outside the housing to pass therethrough. The air moves around the diverter then changes direction between the diverter and the inlet of the pump body before entering the inlet.

In preferred embodiments, the nozzle unit is mounted to the diverter. The jet pump housing is radially spaced from and surrounds the pump body forming a second annular gap between the housing and the pump body. The housing includes an opening positioned radially relative to the pump body such that air outside the housing can enter through the opening and pass through the second annular gap to enter the pump body inlet. The diverter is preferably axially spaced from the pump body about 0.5 inches. The ratio of the diverter diameter to the inlet diameter is about 4 and the ratio of the diverter diameter to its length is about 2.

The nozzle unit preferably includes a series of elongate nozzle tubes arranged in a circle. The nozzle tubes extend into the inlet of the pump body and are angled radially outwardly for directing the pressurized fuel towards the walls of the pump body. The tip portions are preferably positioned along a circle having a diameter of about 0.28 inches and are at an 12° angle relative to each other. The nozzle tubes each have a stem portion with a first diameter and a first wall thickness. Each nozzle tube also has a tip portion with a second diameter and a second wall thickness. The second diameter at the tip portion is smaller than the first diameter of the stem portion with the ratio of the first diameter to the second diameter being about 1.6. The wall thickness at the tip portion is less than the wall thickness of the stem portion. The wall thickness at the tip portion is preferably about 0.003 inches and the wall thickness at the stem portion is preferably about 0.005 inches. The nozzle tubes are about 0.437 inches long with the tip portion being about 0.06 inches long.

The present invention further includes a combustor system including a first spring loaded button protruding radially from the pump body. A combustor attachment combusts an air/fuel mixture received from the outlet of the pump body. The combustor attachment is capable of being releasably coupled to the pump body and has an ignition device for igniting the air/fuel mixture. The combustor attachment has a first hole capable of engaging the first spring loaded button for locking the combustor attachment to the pump body in a first position. The combustor attachment also has a second hole capable of engaging the first spring loaded button for locking the combustor attachment to the pump body in a second position. The combustor system has a first electrical connector positioned in the pump body outlet for providing an electrical charge to the ignition device. The combustor system preferably includes a hollow extension piece having proximal and distal ends capable of being positioned between the pump body and the combustor attachment. The extension piece includes a second electrical connector at the proximal end for engaging the first electrical connector and a third electrical connector at the distal end for engaging the ignition device of the combustor attachment. The second and third electrical connectors are electrically connected together by an electrical conductor. The extension piece includes a proximal hole at the proximal end capable of engaging the first spring loaded button for locking the extension piece to the pump body. The extension piece also has a second spring loaded button at the distal end capable of engaging one of the first and second holes of the combustor attachment for locking the combustor attachment to the extension piece. In one preferred embodiment, the extension piece is telescoping allowing the combustor attachment to be extended or retracted without turning off the jet pump.

The present invention provides a jet pump for a heat gun having a high overall output pressure and a short length that promotes complete smooth quiet combustion that can be easily muffled. The combustor attachment permits quick rotation and removal without the use of tools. The extension piece includes an internal ignition lead that maintains electrical contact regardless of the orientation of the combustor attachment. Hydraulic sealing is made at the same time that the electrical connection is made. More than one extension piece can be used in series between the pump body and the combustor attachment.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
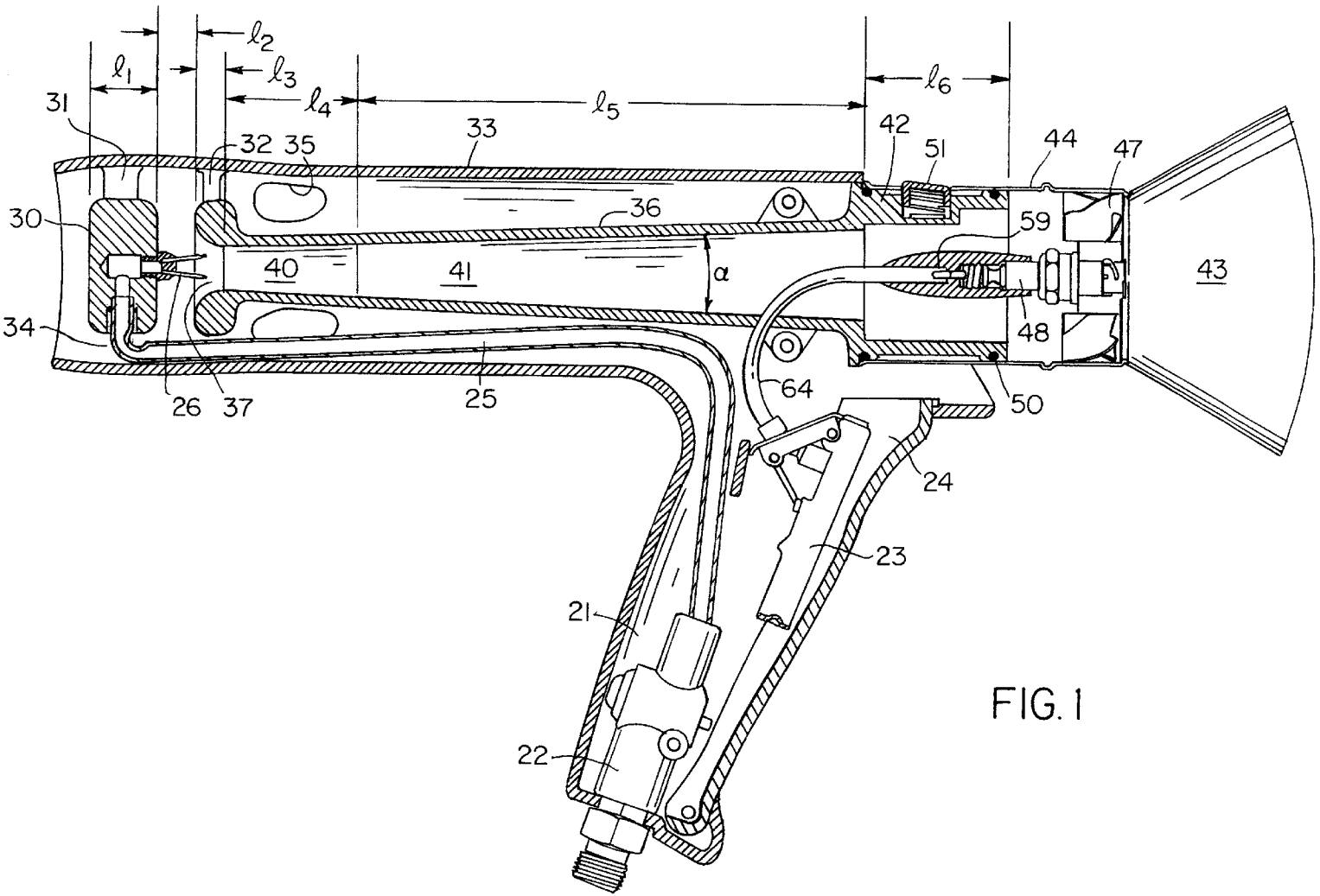
FIG. 1 is a side sectional view of a preferred embodiment of the present heat gun invention.
Figure 2A:
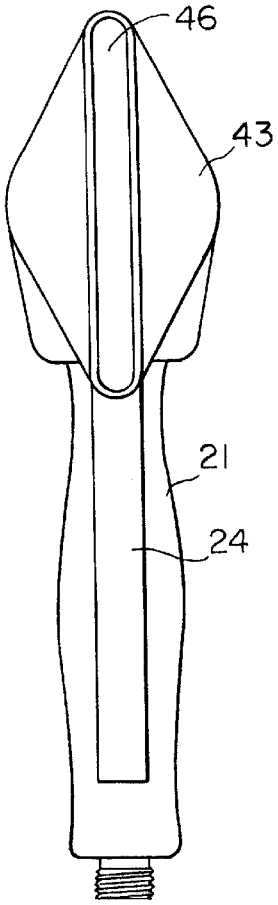
FIG. 2A is a frontal view of the heat gun with the combustor slot in a vertical orientation.
Figure 2B:
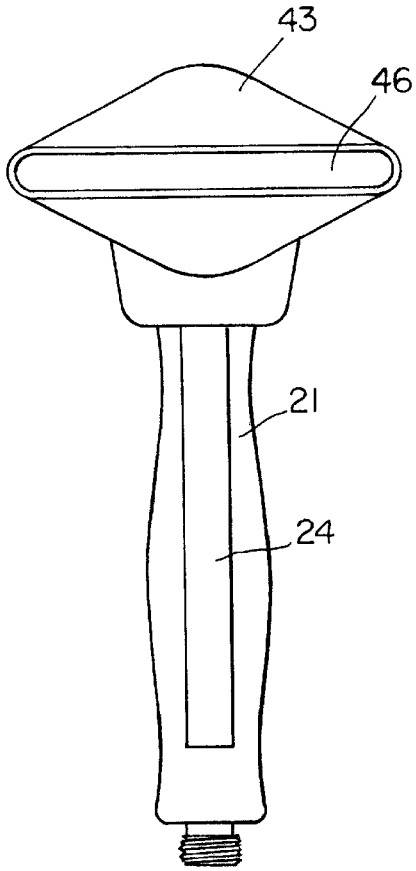
FIG. 2B is a frontal view of the heat gun with the combustor slot rotated to a horizontal orientation.

FIG. 1 shows a cross-sectional view of a heat gun of the present invention. The heat gun comprises a handle 21 which houses a valve 22, an ignitor 23 and a trigger 24. A fuel line 25 leads from the handle 21 to the jet pump nozzle 26. The nozzle 26 is mounted on a flow diverter 30 which is supported by outer struts 31 inside a housing 33 with a rear air inlet 34 and several additional air inlets 35 further forward. Housing 33 also supports a pump body 36. Internally, the pump body 36 contains a bell mouth inlet 37, a cylindrical mixing section 40 and an expanding diffuser 41. A combustor 43 with a flame holder 47 and a spark plug 48 is mounted on a flange 42 of the jet pump 36.

One principal part of the present invention is the construction of the nozzle 26 consisting of multiple nozzle tubes 28 arranged in a circular array diverging from the central axis. This is shown in greater detail in FIGS. 3, 4 and 5.

Figure 6:
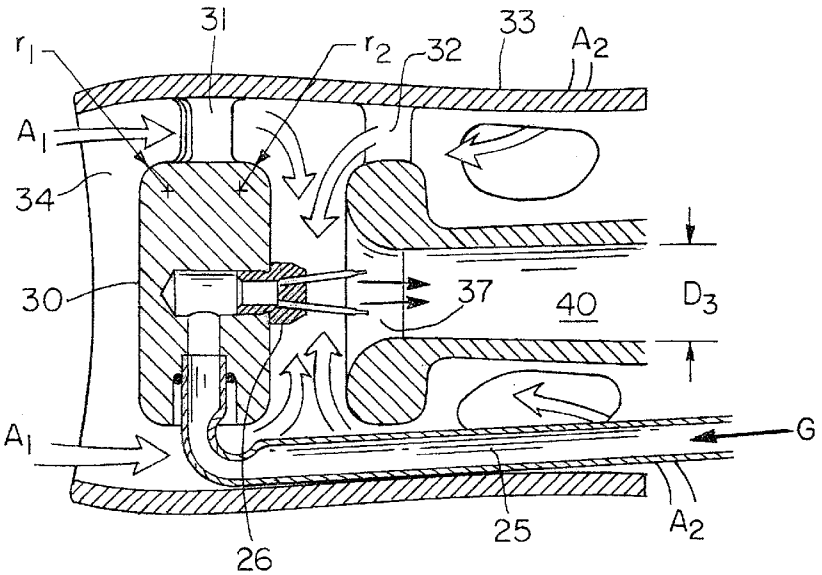
FIG. 6 is an enlarged side sectional view of the inlet structure of the heat gun.

FIG. 6 shows the preferred placement of the nozzle 26 relative to the bell mouthed entry 37 to the mixing section 40. The nozzle tubes 28 protrude into the gap $l_2$ between the flow diverter 30 and the bell mouthed entry 37.

Figure 7:
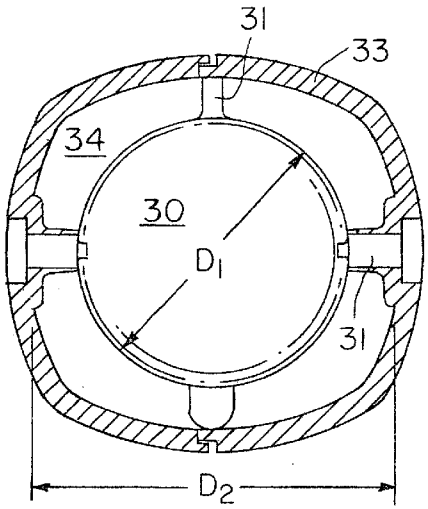
FIG. 7 is an end view of the inlet of the heat gun.

FIG. 7 shows how the nozzle 26 is mounted concentrically relative to the pump body 36 inside the housing 33 by the struts 32.

Figure 3:
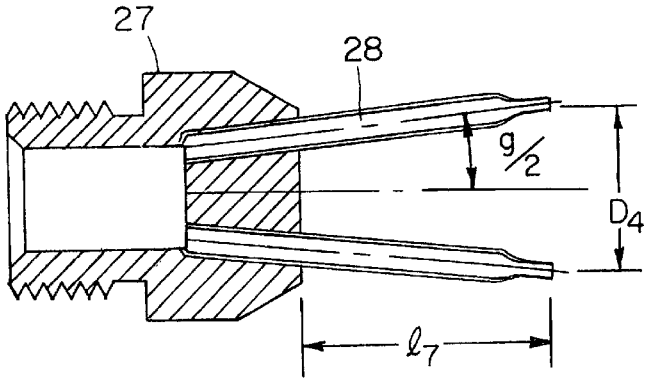
FIG. 3 is a vertical cross-section of the nozzle assembly.

FIG. 3 shows the divergent angle g of the nozzle tubes 28. The divergent angle can be varied if the diameter $D_4$ remains constant.

Figure 4:
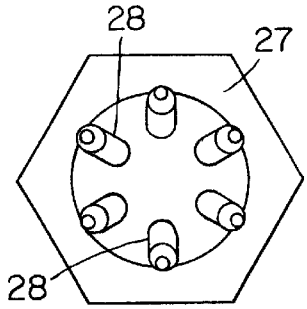
FIG. 4 is a front view of the nozzle assembly.

FIG. 4 show a preferred embodiment utilizing an array of 6 nozzle tubes 28. There are preferably six nozzle tubes 28 but alternatively, more than six or less than six nozzle tubes 28 can be employed.

Figure 5:
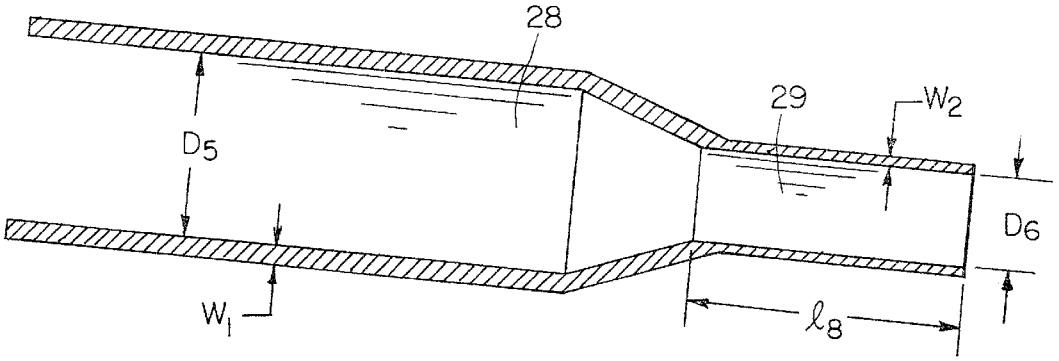
FIG. 5 is an enlarged side sectional view of an individual nozzle.

FIG. 5 shows how the nozzle tubes 28 taper down to a smaller diameter $D_6$ and terminate in a short straight section of length $l_8$. The wall thickness $w_1$, also tapers down to a thinner wall thickness $w_2$ at the nozzle outlet.

Another principal part of the present invention is the flow diverter 30. The structure surrounding the flow diverter 30 is shown in greater detail in FIGS. 6 and 7. The flow diverter 30 is cylindrical or disk shaped and is placed in close proximity with the bell shaped jet pump inlet 37. The outer edges of the flow diverter 30 at the entry to the annular flow passage between it and the housing 33 are rounded as shown by the dimension $r_1$. Similarly, the inner edge at the entry into the radial flow passage between the flow diverter 30 and the pump body 36 are rounded as shown by the dimension $r_2$.

Figure 8:
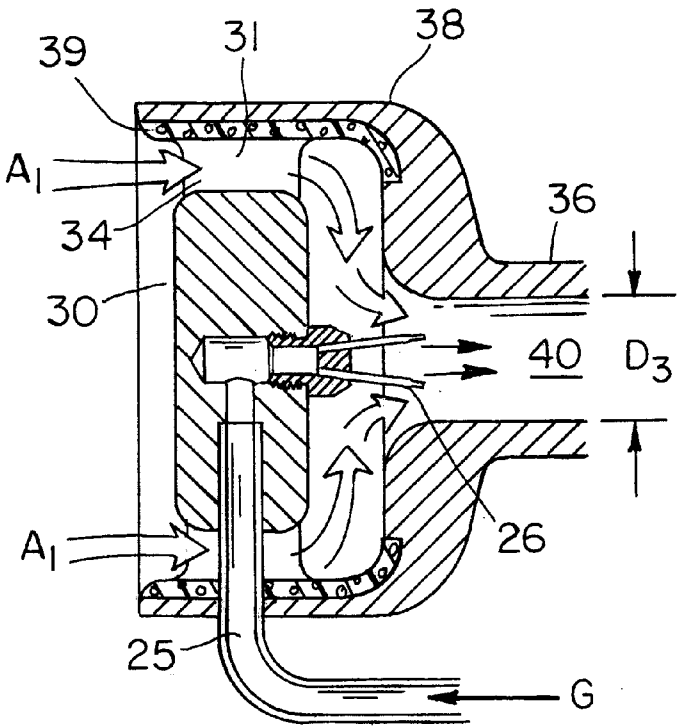
FIG. 8 is a side sectional view of another preferred inlet structure.
Figure 9:
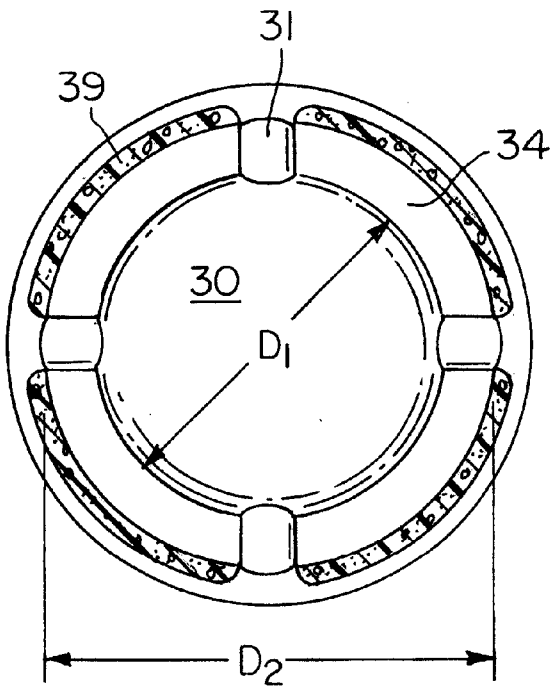
FIG. 9 is an end view of the inlet of FIG. 8.

The flow diverter 30 is shown in another preferred embodiment of the present invention in cross-sectional view in FIG. 8, an end view in FIG. 9. The jet pump inlet is enlarged to form a cylindrical section 38. The flow diverter 30 is supported by struts 31 inside the cylindrical section 38. Also shown in this embodiment is a closed cell foam lining 39 on the inside of the cylindrical section 38 for silencing the noise emanating from the nozzle.

Figure 10:
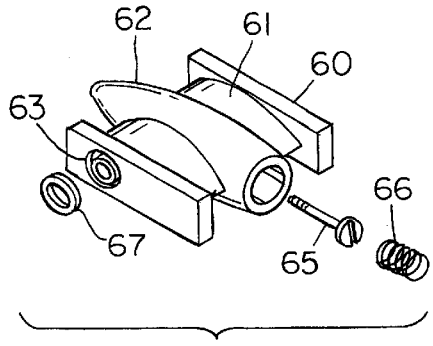
FIG. 10 is an exploded view of the socket assembly.
Figure 11:
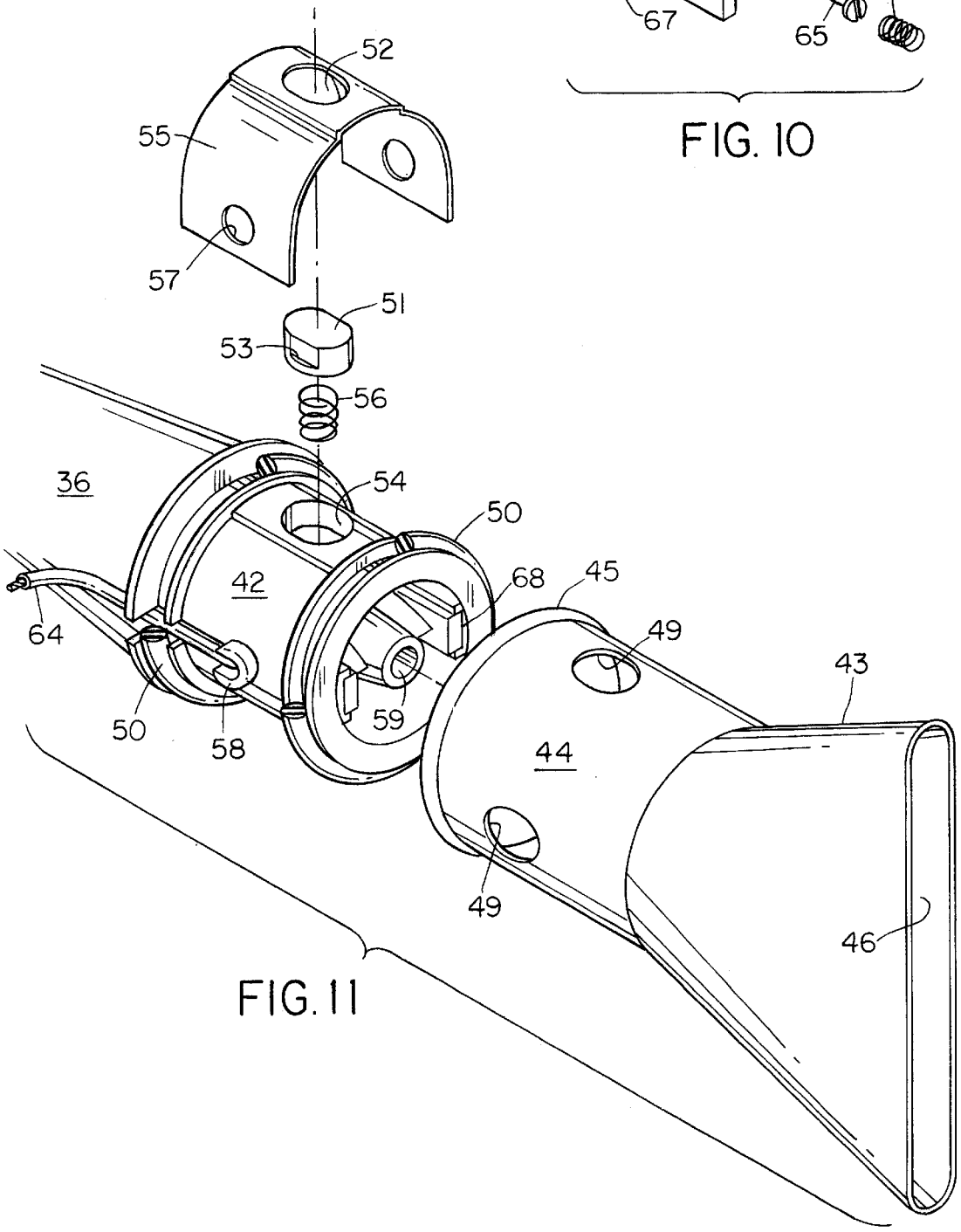
FIG. 11 is an exploded view of the combustor mounting flange and the combustor.
Figure 12:
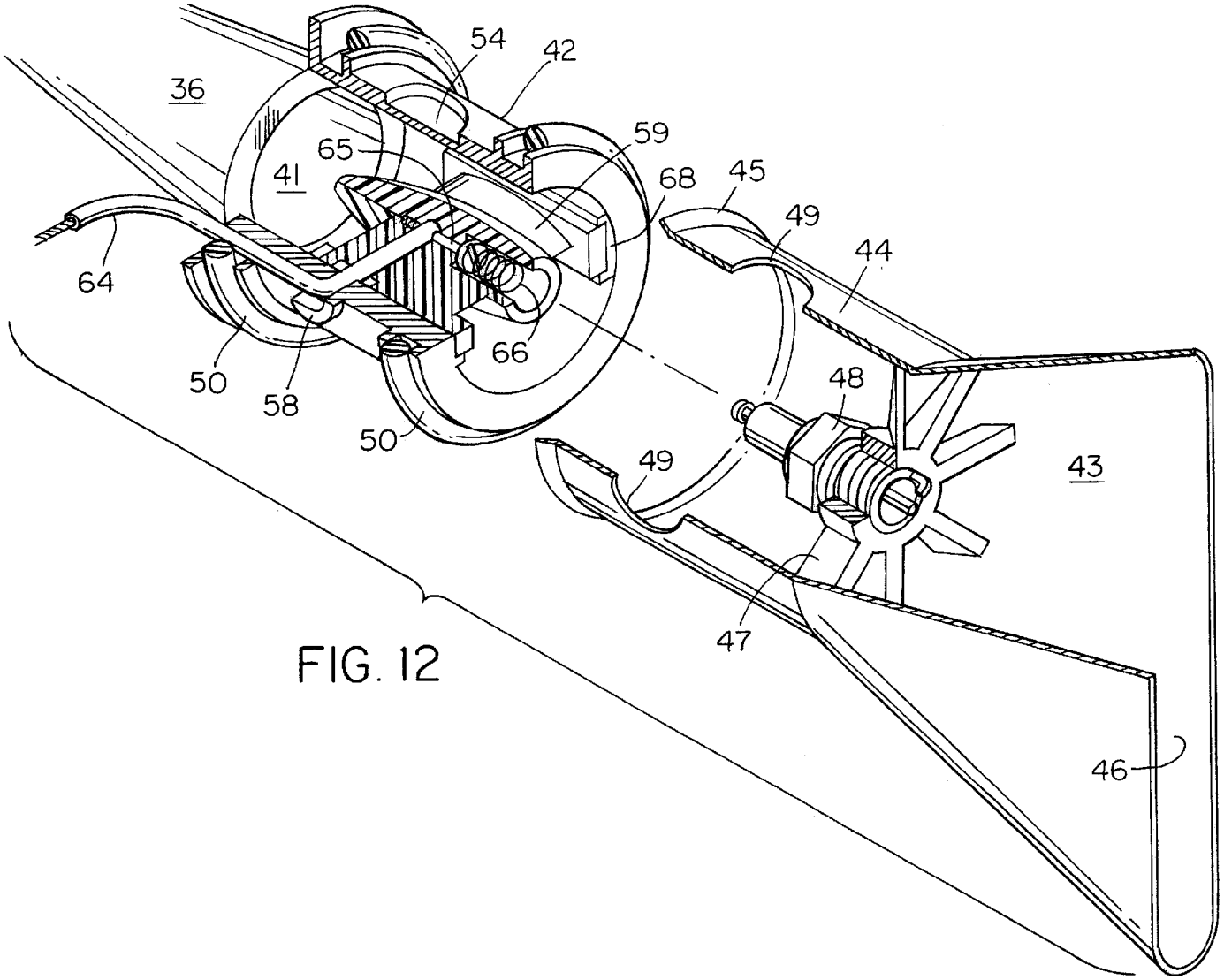
FIG. 12 is a perspective exploded view of the combustor mounting flange and combustor with the internal electrical socket assembly in cross section.

The quick connect feature of the combustor can be seen in FIGS. 10, 11 and 12. FIG. 10 shows a socket 59 made of an insulating material such as plastic. It contains a metallic contact spring 66 which is located in the center of the socket body 62 by a axial screw 65 in communication with a cross bore 63. Cross bore 63 is recessed to receive a O-ring seal 67.

FIG. 11 shows the combustor mounting flange 42 of the pump body 36 with two O-rings 50. The flange 42 has a cavity 54 in which a button 51 and spring 56 are retained by a bracket 55 with an aperture 52 through which the head of the button can move but through which the button flange 53 cannot pass. The bracket 55 is held in place by two diametrically opposed bosses 58 and the locating holes 57.

The combustor attachment 43 has a beveled edge 45 and a cylindrical section 44 which mates with the O-rings 50. It also has two locating holes 49 placed at 90 degrees to each other to mate with the button 51.

The working parts which establish the electrical connection are shown in detail in FIG. 12. The insulated ignition cable 64 feeds into the cross bore 63 of the insulated socket 59. Screw 65 pierces the cable and holds it in place while simultaneously establishing contact with the spring 66. Spring 66 mates with spark plug 48 located in the axis of the cylindrical combustor section 44 by a flame holder 47.

Figure 13B:
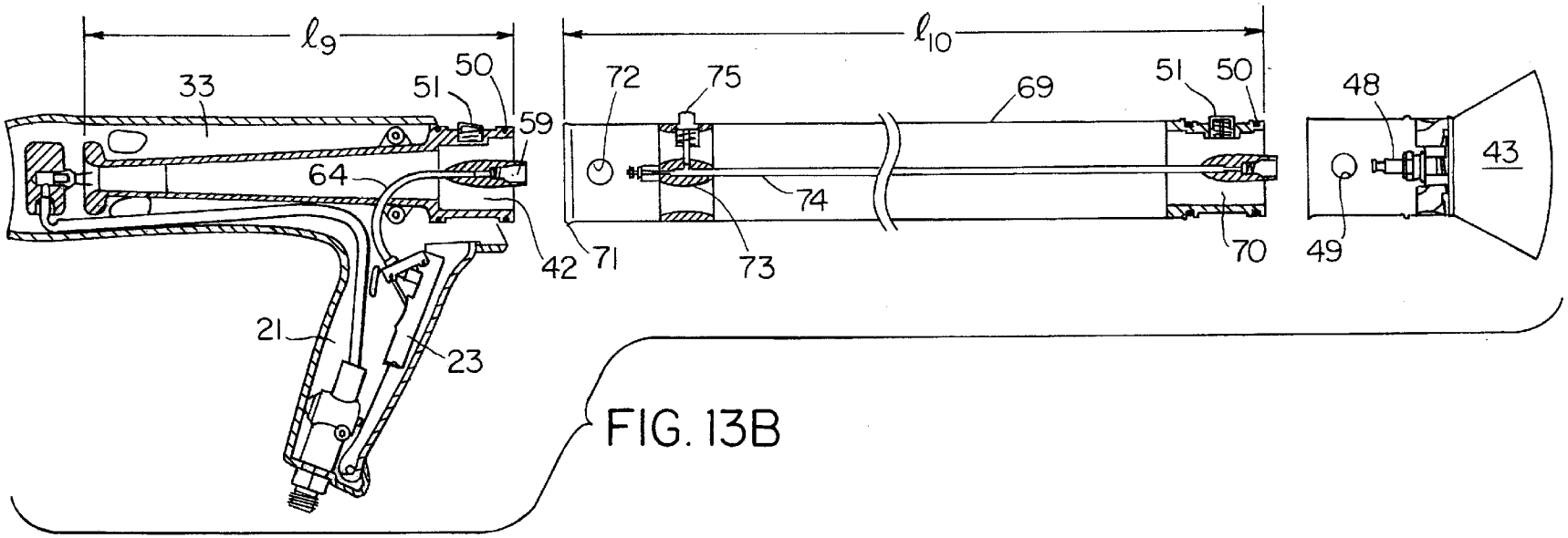
FIG. 13B is a side sectional view of the heat gun showing the insertion of a combustor extension.
Figure 13A:
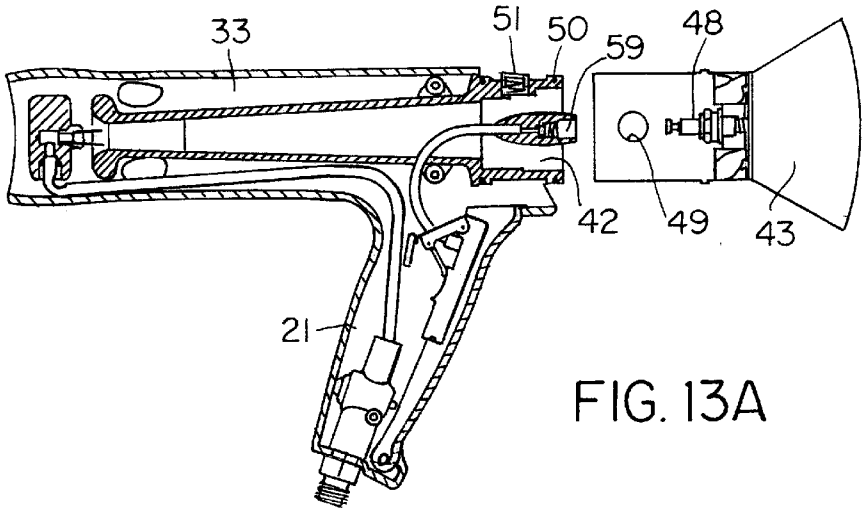
FIG. 13A is a side sectional view of the heat gun showing the removal of the combustor.
Figure 14:
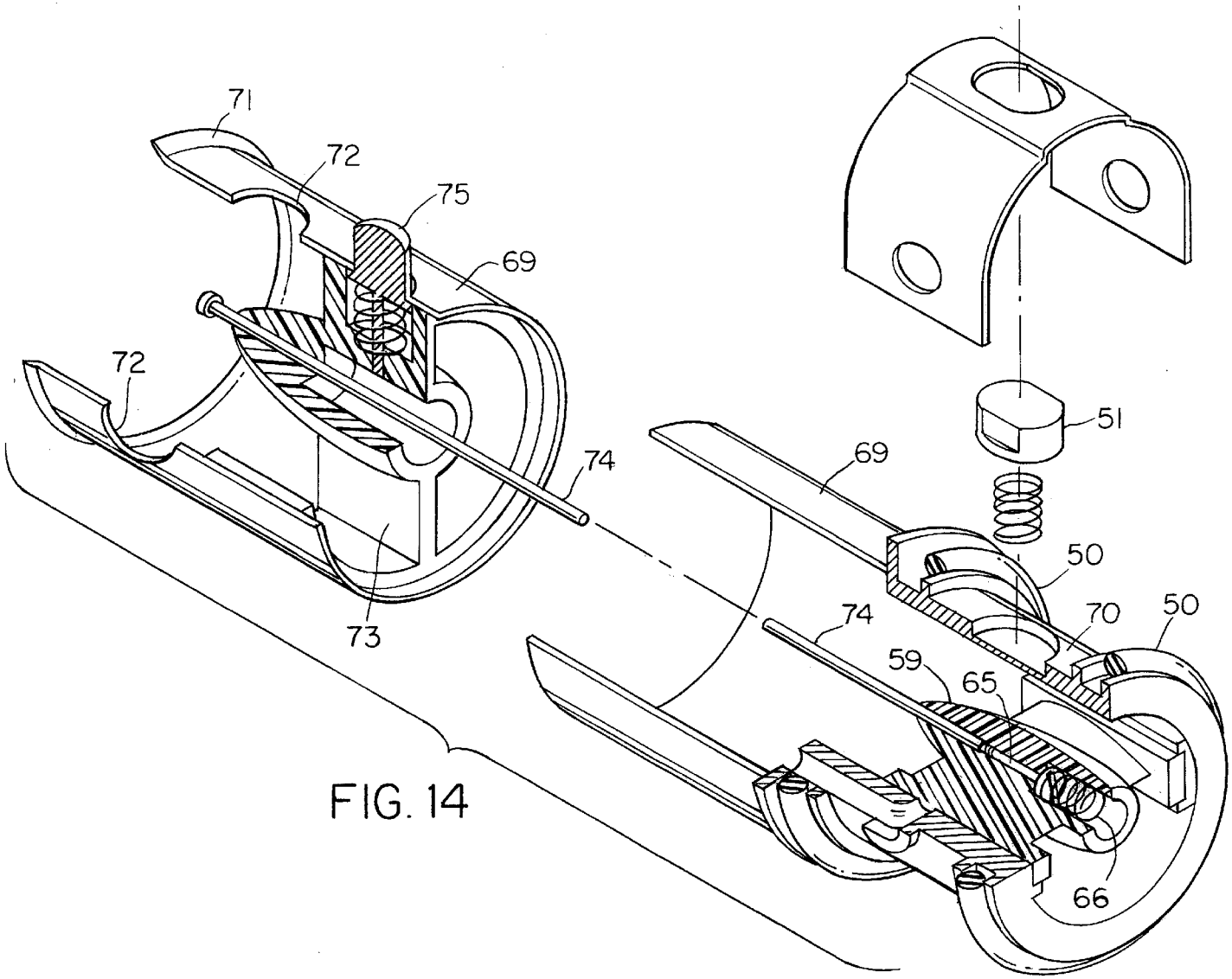
FIG. 14 is a perspective sectional view of the combustor extension with the locking button in exploded view.

FIGS. 13B and 14 show the construction of an extension tube 69. At its inlet end the extension tube 69 is fashioned like the cylindrical section 44 of the combustor 43, with a beveled edge 71 and locating holes 72. The extension ignition lead 74 is located on the axis by the insulated plug holder 73 in position to mate with the socket 59 and contact spring 66. At its outlet end the extension tube 69 terminates in a mounting flange similar to the mounting flange 42 with O-rings 50, button 51 and socket 59 with contact spring 66 and screw 65. One difference in construction is that the extension ignition lead 74 runs axially down the extension tube and feeds axially into the socket body 62. The extension ignition lead 74 and associated connectors are preferably positioned along the central axis of the extension tube 69 to be away from the walls thereof. If the extension ignition lead 74 is positioned too close to the walls of the extension tube 69, the extension ignition lead 74 behaves as a capacitor and stores electric charges rather than delivers electric charges to spark plug 48.

Figure 15A:
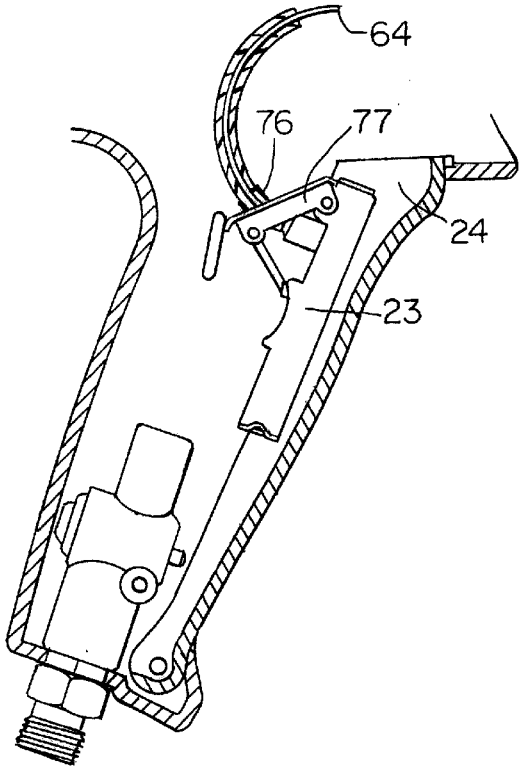
FIG. 15A is a side sectional view of the ignitor before firing.

The extension tube 69 also carries a metal grounding pin 75 which is spring loaded in the plug holder 73. Another preferred embodiment in place of the grounding pin 75 is shown if FIGS. 15A, 15B and 15C. The insulated ignition lead 64 emanating from the ignitor 23 carries a metal clip 76 which clamps around it and pierces it to establish electrical contact. The metal clip 76 is located on the ignition lead 64 in such a manner that it touches the ignitor link 77 when the trigger 24 is in the released position as shown in FIG. 15A. When the trigger 24 is depressed the ignitor link 77 rocks to actuate the ignitor 23 and breaks the contact with the metal clip 76.

Figure 16A:
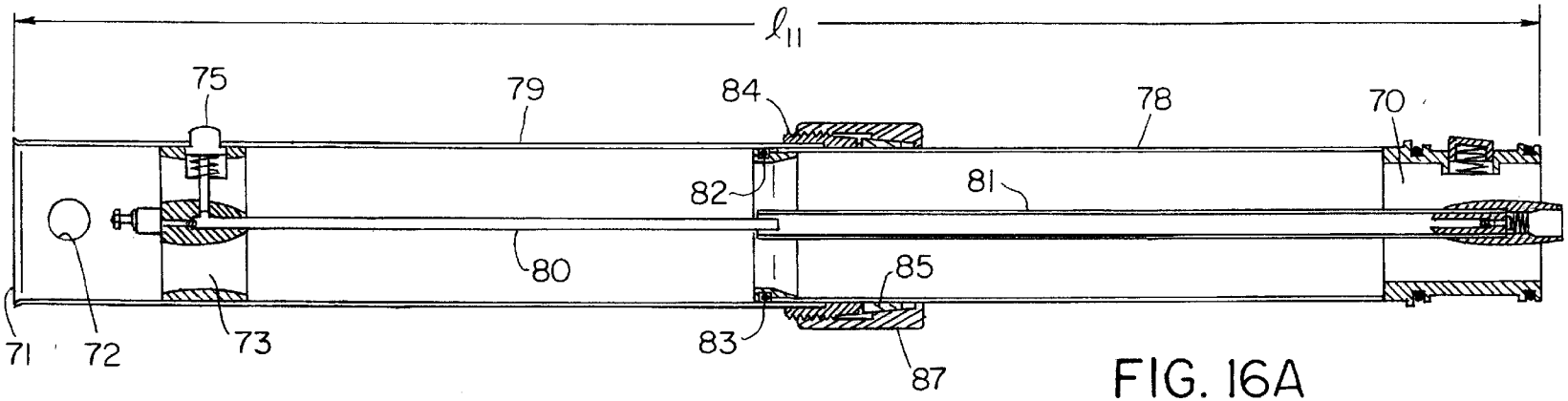
FIG. 16A is a side sectional view of another preferred combustor extension in the extended position.
Figure 16B:
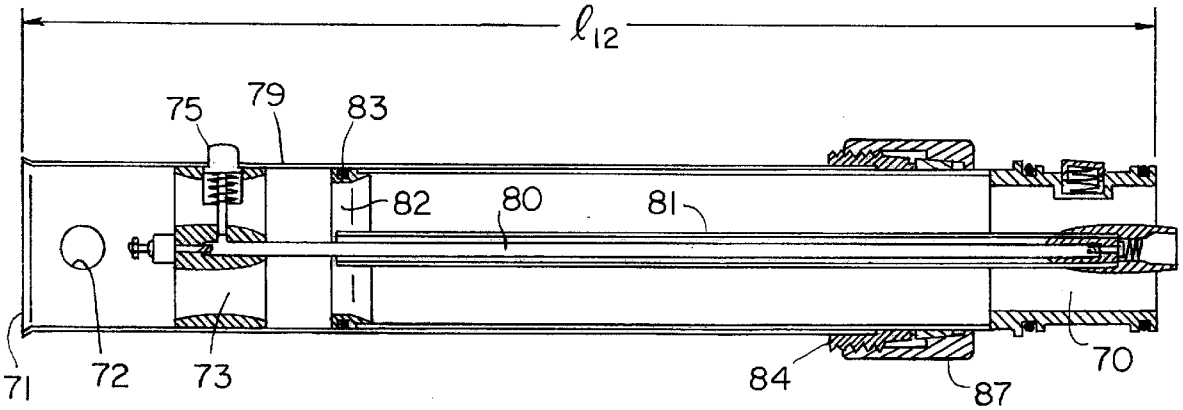
FIG. 16B is a side sectional view of the combustor extension of FIG. 16A in the contracted position.
Figure 17:
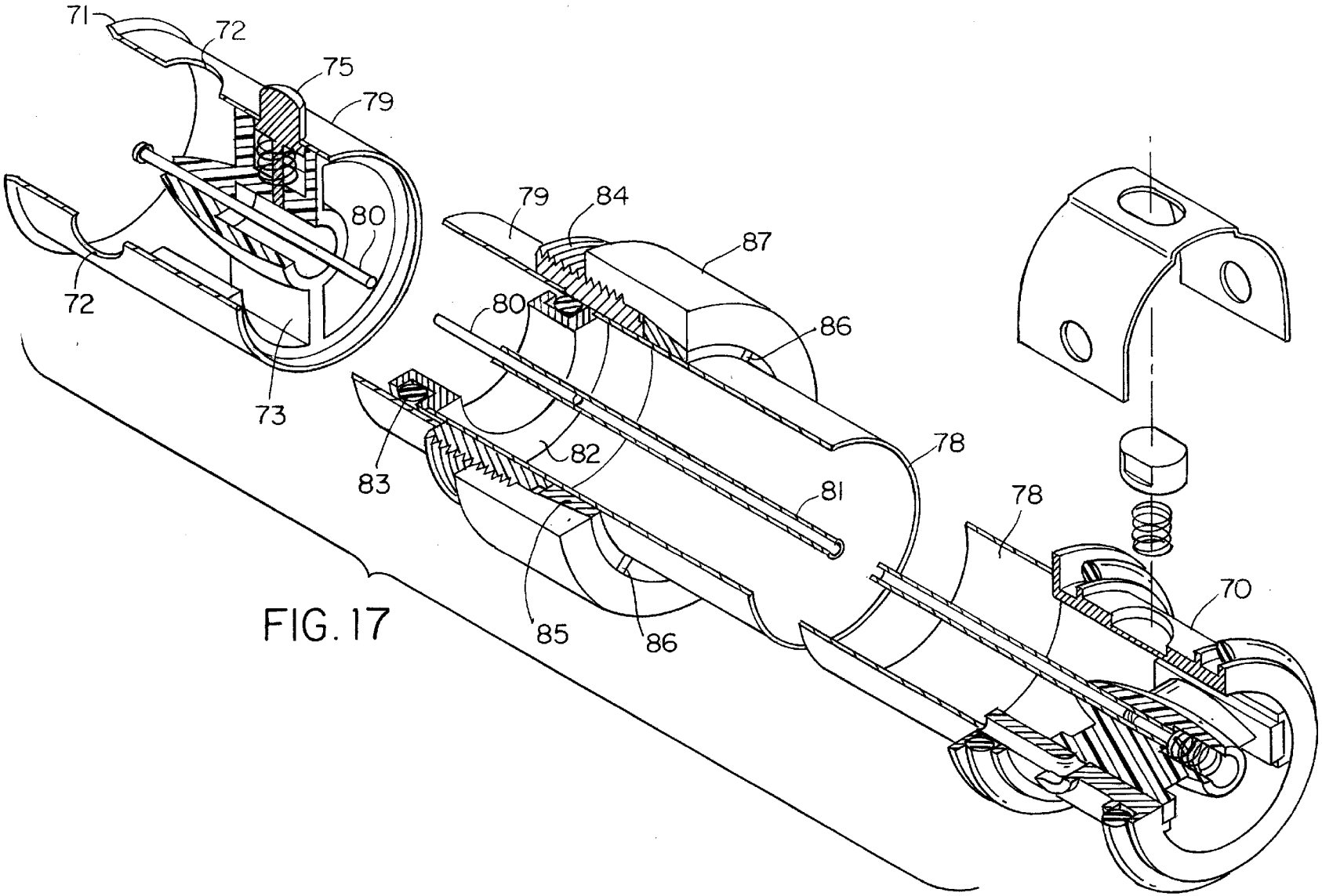
FIG. 17 is a perspective view of the sliding joint of that combustor extension with a portion in section.

Another preferred combustor extension is shown in FIGS. 16A, 16B and 17. Its distinguishing feature is that it employs two telescoping extension tubes, a inner extension tube 78 and an outer extension tube 79 joined by a compression fitting 83 and a compression nut 87. The compression fitting 83 has a cone shaped end 85 with serrations 86 which mate with the conical internal diameter of the compression nut 87. The inner extension tube 78 carries a stop collar 82 with an O-ring seal 83. Telescoping rod 80 and tube 81 function as an ignition lead.

In a typical construction in accordance with the embodiment of FIGS. 1 and 3–9 the dimensions may be selected as follows:

$l_1$=0.750 in.
$l_2$=0.500 in.
$l_3$=0.250 in.
$l_4$=1.400 in.
$l_5$=5.500 in.
$l_6$=1.400 in.
$l_7$=0.437 in.
$l_8$=0.060 in.
$l_9$=8.550 in.
$l_{10}$=36 in.
$l_{11}$=54 in.
$l_{12}$=30 in.
$D_1$=1.500 in.
$D_2$=2.250 in.
$D_3$=0.375 in.
$D_4$=0.280 in.
$D_5$=0.040 in.
$D_6$=0.024 in.
$w_1$=0.005 in.
$w_2$=0.003 in.
a=5 degrees
g=12 degrees Actuating the trigger 24 opens the valve 22 admitting the pressurized fuel gas G. The gas is led to the nozzle 26 by the fuel line 25. At the nozzle, the pressure of the gas is expanded into the kinetic energy of multiple streams issuing from each nozzle tube 28 entraining the surrounding air. The momentum transfer from the gas to the air is accomplished in the straight walled mixing duct 40. Some of the kinetic energy of the mixture is subsequently transformed to static pressure in the diffusor 41, and the pressurized mixture is fed into the combustor 43.

In common with other multi-nozzle jet pumps of the prior art, the present invention has the advantage of needing a much shorter mixing duct 40 to accomplish the mixing process than in a single nozzle jet pump. This leads to lower wall friction losses in the mixing duct and enhanced performance.

Figure 19:
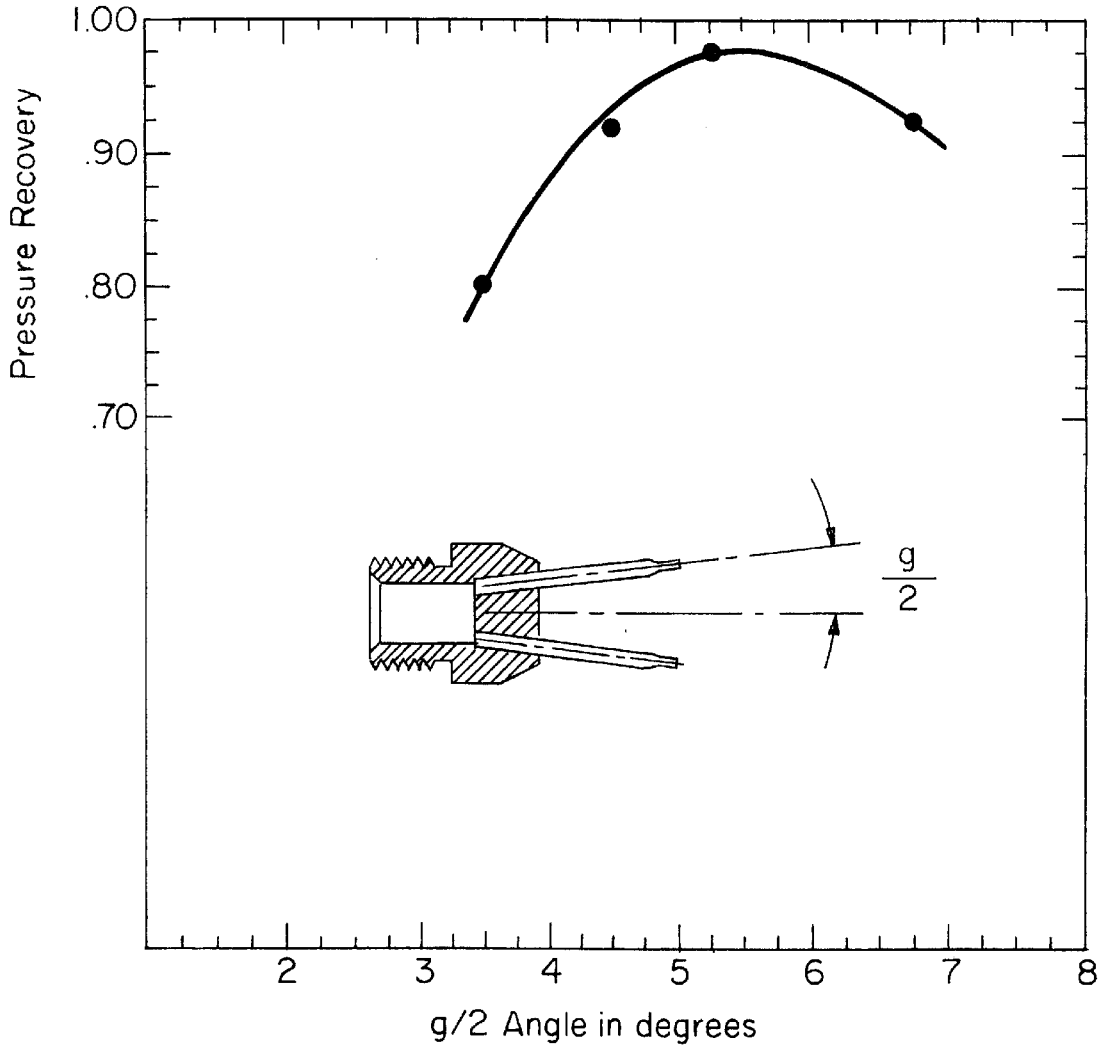
FIG. 19 is a performance graph of the present heat gun invention as a function of the spread angle of the nozzle tubes.

The performance of the present invention is improved further by the diverging placement of the nozzle tubes 28. This relationship is illustrated in FIG. 19. The divergent placement of nozzle tubes 28 pushes most of the entrained fluid to the outside of the mixing section. The velocity profile at the exit of the mixing section shows a pronounced peak close to the wall.

Aiming the gas nozzles at the walls appears detrimental to performance since forward momentum of the gas is sacrificed and, in addition, wall friction should increase. It is believed however that this velocity profile leads to greater diffusor efficiencies which more than make up for the aforementioned losses. By concentrating the bigger part of the flow energy close to the wall, the separation of the boundary layer of the diffuser is delayed. Stall and separation are thus avoided. As a result, diffusor efficiency is high and a greater overall pressure recovery is possible in spite of possibly higher wall friction due to the higher velocities near the wall.

Figure 20:
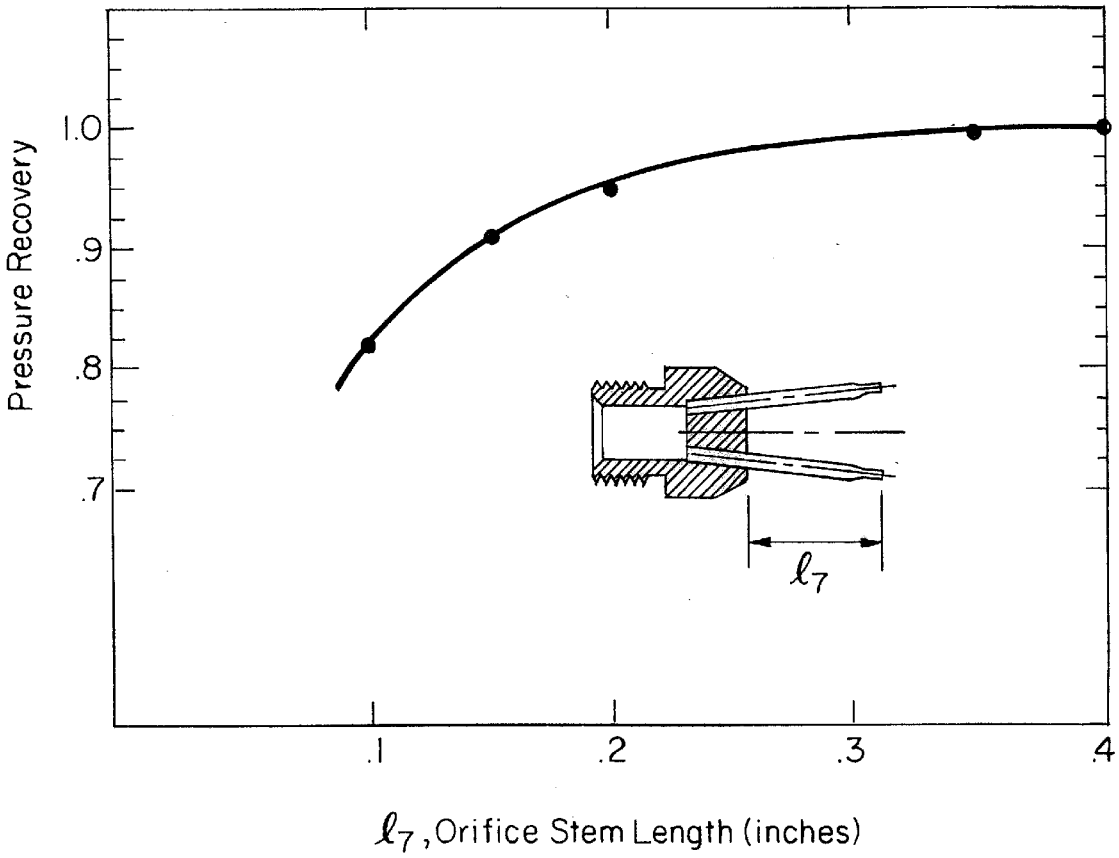
FIG. 20 is a performance graph of the present heat gun invention as a function of the length of the nozzle tubes.

The mixing process is improved by making the wall thickness $w_2$ of the nozzle tubes 28 as thin as possible to minimize eddy formation in the entrainment process and lengthening them to reach into the vicinity of the bell mouthed entry 37. The benefits that can be derived by lengthening the nozzle tubes 28 is shown in FIG. 20. Lengthening the nozzle tubes 28 without undue pressure losses requires a larger nozzle tube diameter $D_5$. However, the benefit of enlarging the nozzle tube diameter to minimize gas pressure losses has to be balanced against the draw-back of the increased drag losses in the aspirated air stream. For this reason it is desirable to use as thin a nozzle tube wall $w_1$ as possible consistent with the requirements of structural strength.

The performance is more consistent if the nozzle tubes 28 are fashioned to have a straight section with an L/D of more than 2 after tapering down to the small discharge diameter $D_6$. This may be due to the better guidance of the jet discharge direction that this geometry affords.

The combustion air is not aspirated into the jet pump by the path of least resistance but is forced to make two right angle turns before entering the jet pump. This is illustrated in FIG. 8. The air A1 enters the annular gap between the cylindrical inlet portion 38 and the flow diverter 30 in an axial direction. It is then deflected radially inward in the space between the flow diverter 30 and the pump body 36. Subsequently, it is again deflected 90 degrees as it enters the bell mouthed inlet 37 to the jet pump in an axial direction. The basic function of the flow diverter 30 is to establish this tortuous flow patter. Without it, the air would rush in unrestrained. To minimize pressure losses at the entry to the annular passage the leading edges are rounded as shown by r1. To minimize pressure losses due to turning the flow from an axial to a radial direction the inside corners of the flow diverter 30 are rounded as shown by r2.

The preferred embodiment of the invention shown in FIG. 6 operates in a similar fashion. The end of the pump body 36 is fashioned to match the flow diverter 30 in size and shape, and it mounts in the housing 33 by the inner struts 32 in the same fashion as the flow diverter 30. As a result, a second flow pattern is established tor combustion air $A_2$ drawn in through the front air openings 35 which mirrors the flow pattern of combustion air $A_1$ drawn in through the rear air opening 34.

The operation of the quick connect feature of the invention is as follows. To change the direction of the combustor slot 46 the operator merely depresses the button 51 and turns the combustor 43 until the button 51 pops into the next locating hole 49. To disconnect, the operator merely depresses the button 51 and pulls the combustor 43 off. Re-attachment is even simpler since the beveled edge 45 obliviates the need to depress the button by the operator as the combustor 43 is pushed back on.

By virtue of the centrally located electrical socket 59 and spark plug 48 the electrical connection is established simultaneously with the hydraulic connection or sealing for the combustion gases without regard to the rotation of the combustor 43 relative to the housing 33.

Figure 15B:
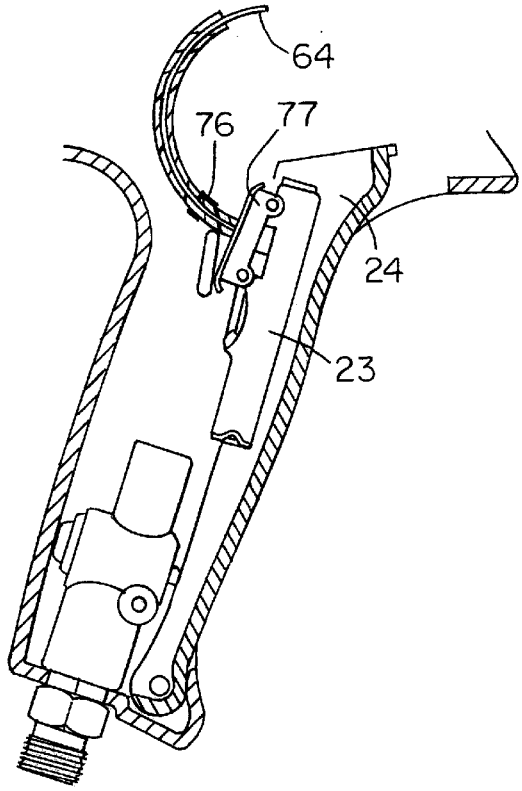
FIG. 15B is a side sectional view of the ignitor after firing.
Figure 15C:
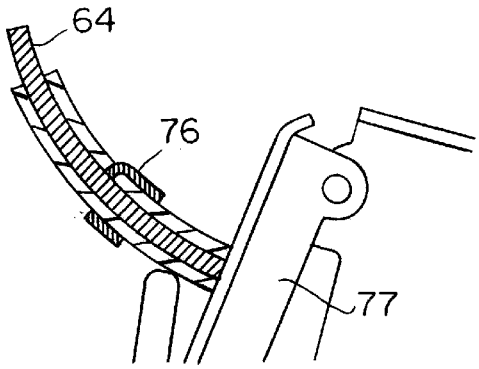
FIG. 15C is an enlarged side sectional view of the ignitor after firing showing the ground clip.

The installation and removal of an extension tube follows the same pattern. When using the extension and firing the gun repeatedly, a high voltage charge builds up on the internal ignition lead, since the spark plug does not discharge the ignitor completely and the capacitance of the lead inside the extension tube blocks further ignition until the charge is dissipated. To promote a quick discharge the spring loaded grounding pin 75 can be depressed until it contacts the ignition lead 74. Another, preferred embodiment of this feature is shown in FIG. 15A, FIGS. 15B and 15C. The grounding clip 76 is located so that it automatically discharges any residual voltage in the ignition lead 64 by touching the grounded ignitor link 77 when the trigger 24 is released.

As shown in FIGS. 16A and 16B, the telescoping extension tube facilitates an easy change in the length of the extension to reach both near and far while the heat gun is running. The operator merely loosens the compression nut 87. This releases the pressure on the conical serrated compression fitting 84 and the inner extension tube can be slid out to the desired length.

A jet pump built with the dimensions shown in FIGS. 1–6 was compared to a jet pump with a single nozzle of the same gas consumption. The dimensions of the single nozzle pump were kept the same except for using a longer and bigger diameter mixing section 30 to achieve optimum performance. The single nozzle pump thus had to be 3 inches longer.

Figure 18:
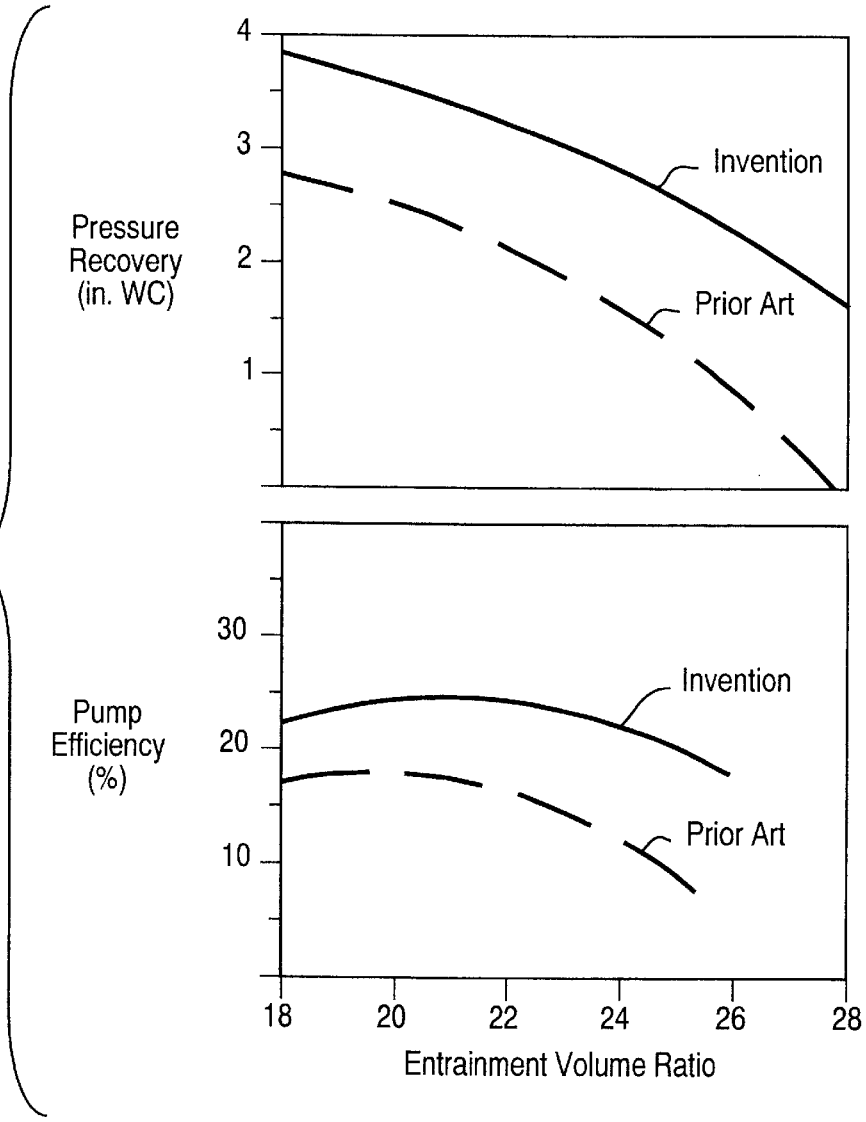
FIG. 18 is a performance graph of the present heat gun invention in comparison with a heat gun having a single nozzle jet pump.

Both pumps were set up to run on pressurized air at 22 psi entraining ambient air. The output pressure was measured by a pressure gage. The output volume was controlled with a Gate Valve and measured by a Flow Meter. The results of a representative test are shown in FIG. 18 as a plot of output pressure versus pump volume. From this data the power output and pump efficiencies of the two pumps can be calculated, also shown in FIG. 18.

The present invention achieves a pump efficiency of 24% compared to 17% achievable in the prior art, a 40% improvement in output power. Yet it is 3 inches, or 25% shorter.

Figure 21:
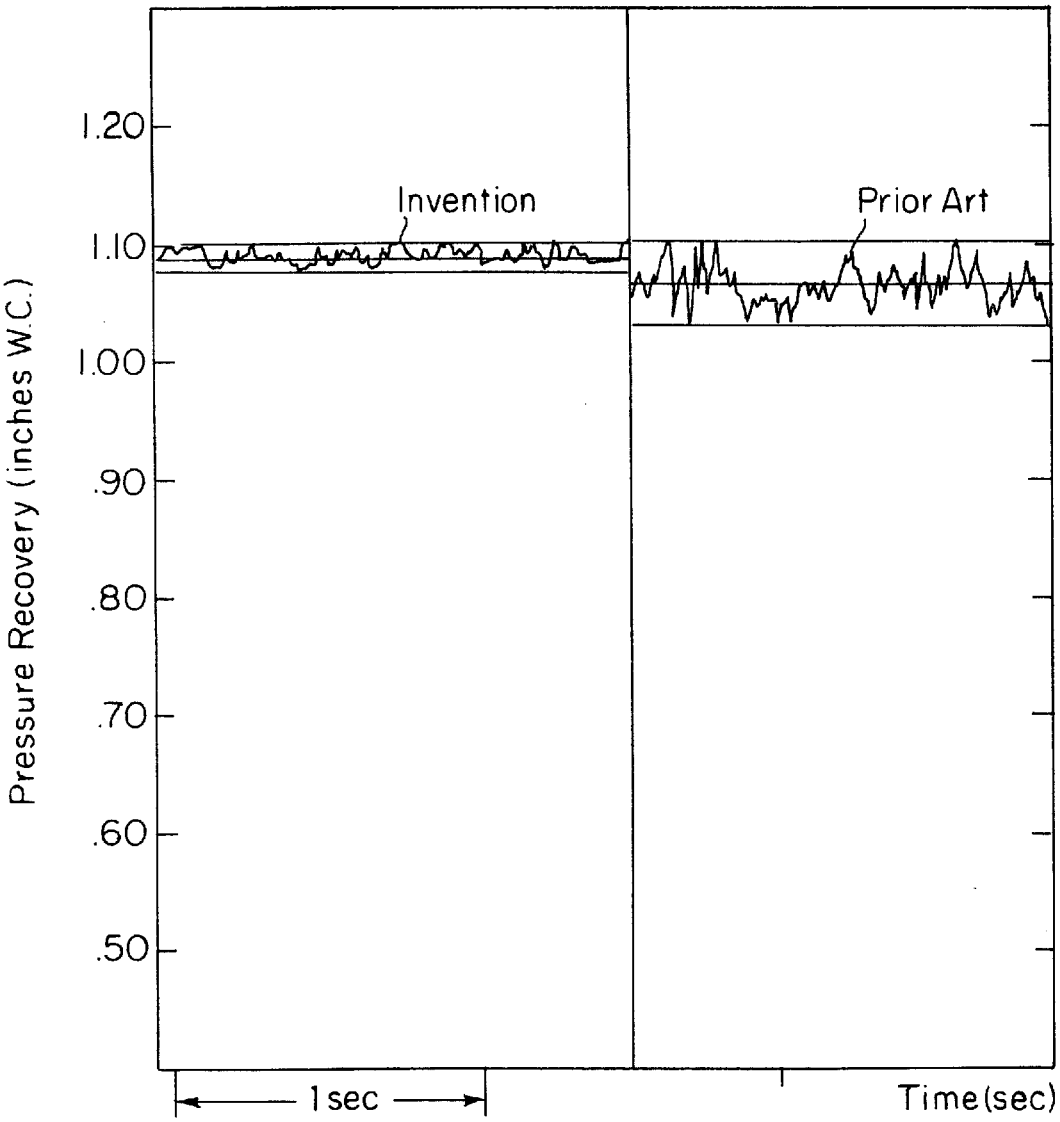
FIG. 21 is a graph showing the fluctuation of Output Pressure vs. Time of the present invention compared to prior art heat guns.

To demonstrate the improvement that can be achieved with the flow diverter of the present invention compared to the prior art, another bench test was performed. A jet pump built with the dimensions according to the present invention was set up running on pressurized air at 22 psi entraining ambient air. The output pressure was monitored with a pressure transducer connected to a strip chart recorder. The output volume was controlled with a gate valve and measured by an orifice plate. After running for 2 minutes the flow diverter 30 was removed to simulate the prior art and the test was continued for another 2 minutes. The results of a representative test are shown in FIG. 21.

Both pumps achieve the same peak pressure of 1.10" water column, but the jet pump of the present invention has a fluctuation of only 0.02" compared to a fluctuation of 0.07" of the prior art, more than a three fold improvement in output pressure fluctuation.

In addition to running more smoothly, the jet pump of the present invention also has a discernibly higher average output pressure: 1.09" vs. 1.06". While this improvement is only slight it is significant in that the invention achieves the goal of smoother output without any loss in performance. On the contrary, there is a net gain in performance.

This is remarkable inasmuch as the invention introduces two right angle turns to the incoming flow. Given the pressure losses due to the turns of the flow of the present invention, the reasonable expectation is that it should suffer from a drop, not a gain in performance.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

For example, the jet pump of the present invention can be used for other suitable purposes other than on a heat gun.

What is claimed is:

1. A combustor extension for a heat gun, the heat gun having a jet pump for mixing pressurized fuel with air to form an air/fuel mixture, and a combustor attachment for combusting the air/fuel mixture, the jet pump having a first electrical connector for providing an electrical charge to an ignition device at the combustor attachment for igniting the air/fuel mixture, the combustor extension comprising:

a straight rigid hollow conduit having proximal and distal ends for extending between and coupling the combustor attachment to the jet pump the conduit having a central axis;

a second electrical connector at the proximal end of the conduit for electrically coupling to the first electrical connector of the jet pump; and a third electrical connector at the distal end of the conduit for electrically coupling to the ignition device of the combustor attachment, the second and third electrical connectors being electrically connected together by an electrical conductor, the second electrical connector, the electrical conductor and the third electrical connector being positioned along the central axis of the conduit, the electrical conductor being maintained a sufficient distance away from conductive walls to prevent the formation of a capacitor therebetween while allowing passage of the air/fuel mixture through the conduit.

2. The extension of claim 1 in which the jet pump has a first spring loaded button protruding radially from the jet pump and the combustor attachment includes a first hole, the conduit of the extension having a proximal hole at the proximal end capable of engaging the first spring loaded button of the jet pump for locking the extension to the jet pump, the conduit of the extension also having a second spring loaded button at the distal end capable of engaging the first hole of the combustor attachment for locking the combustor attachment to the extension.

3. The extension of claim 1 in which the conduit is telescoping.

4. The extension of claim 1 further comprising a charge dissipater for dissipating residual electrical charges in the ignition device.

5. The extension of claim 1 further comprising sealing arrangements at the proximal and distal ends of the conduit for sealing the conduit to the jet pump and the combustor attachment.

6. The extension of claim 5 in which the sealing arrangements each comprise a mounting flange with at least one "O" ring positioned thereon for providing hydraulic sealing.

7. The extension of claim 4 in which the charge dissipater comprises a grounding member movable into electrical communication with the electrical conductor for dissipating the residual electrical charges.

8. A combustor extension for a heat gun, the heat gun having a jet pump for mixing pressurized fuel with air to form an air/fuel mixture, and a combustor attachment for combusting the air/fuel mixture, the jet pump having a first electrical connector for providing an electrical charge to an ignition device at the combustor attachment for igniting the air/fuel mixture, the combustor extension comprising:

a straight rigid hollow conduit having proximal and distal ends for extending between and coupling the combustor attachment to the jet pump, the conduit having a central axis;

a second electrical connector at the proximal end of the conduit for electrically coupling to the first electrical connector of the jet pump;

a third electrical connector at the distal end of the conduit for electrically coupling to the ignition device of the combustor attachment, the second electrical connector being electrically connected to the third electrical connector by an electrical conductor, the second electrical connector, the electrical conductor and the third electrical connector being positioned along the central axis of the conduit, the electrical conductor being maintained a sufficient distance away from conductive walls to prevent the formation of a capacitor therebetween, while allowing passage of the air/fuel mixture through the conduit; and a charge dissipater for dissipating residual electrical charges in the ignition device, the charge dissipater comprising a grounding member movable into electrical communication with the electrical conductor for dissipating the residual electrical charges.

9. The extension of claim 8 in which the jet pump has a first spring loaded button protruding radially from the jet pump and the combustor attachment includes a first hole, the conduit of the extension having a proximal hole at the proximal end capable of engaging the first spring loaded button of the jet pump for locking the extension to the jet pump, the conduit of the extension also having a second spring loaded button at the distal end capable of engaging the first hole of the combustor attachment for locking the combustor attachment to the extension.

10. The extension of claim 8 in which the conduit is telescoping.

11. The extension of claim 8 further comprising sealing arrangements at the proximal and distal ends of the conduit for sealing the conduit to the jet pump and the combustor attachment.

12. The extension of claim 11 in which the sealing arrangements each comprise a mounting flange with at least one "O" ring positioned thereon for providing hydraulic sealing.

13. A method of forming a combustor extension for extending a combustor attachment from a jet pump of a heat gun wherein the jet pump mixes pressurized fuel with air to form an air/fuel mixture and the combustor attachment combusts the air/fuel mixture, the jet pump having a first electrical connector for providing an electrical charge to an ignition device at the combustor attachment for igniting the air/fuel mixture, the method comprising the steps of:

forming a straight rigid hollow conduit having proximal and distal ends for extending between and coupling the combustor attachment to the jet pump, the conduit having a central axis;

positioning a second electrical connector at the proximal end of the conduit for electrically coupling to the first electrical connector of the jet pump; and positioning a third electrical connector at the distal end of the conduit for electrically coupling to the ignition device of the combustor attachment, the second and third electrical connectors being electrically connected together by an electrical conductor the second electrical connector, the electrical conductor and the third electrical connector being positioned along the central axis of the conduit, the electrical conductor being maintained a sufficient distance away from conductive walls to prevent the formation of a capacitor therebetween, while allowing passage of the air/fuel mixture through the conduit.

14. The method of claim 13 in which the jet pump has a first spring loaded button protruding radially from the jet pump and the combustor attachment includes a first hole, the method further comprising the steps of:

providing the conduit with a proximal hole at the proximal end of the conduit for engaging the first spring loaded button of the jet pump for locking the extension to the jet pump; and providing the conduit with a second spring loaded button at the distal end of the conduit with the first hole of the combustor attachment for locking the combustor attachment to the extension.

15. The method of claim 13 further comprising the step of providing a charge dissipater for dissipating residual electrical charges in the ignition device.

16. The method of claim 15 in which providing the charge dissipater comprises providing a grounding member movable into electrical communication with the electrical conductor for dissipating the residual electrical charges.

17. The method of claim 13 further comprising the step of providing sealing arrangements at the proximal and distal ends of the conduit for sealing the conduit to the jet pump and the combustor attachment.

18. The method of claim 17 further comprising the step of providing each sealing arrangement with a mounting flange and at least one "O" ring positioned thereon for providing hydraulic sealing.

* * * * *

UNITED STATES PATENT AND TRADEMARK OFFICE

CERTIFICATE OF CORRECTION

PATENT NO. : 6,227,846 B1
DATED : May 8, 2001
INVENTOR(S) : Dimiter S. Zagoroff

It is certified that error appears in the above-identified patent and that said Letters Patent is hereby corrected as shown below:

Column 9,
Line 48, after "jet pump" insert -- , --;
Line 62, after "therebetween" insert -- , --.

Column 10,
Line 19, delete "5 in which the charge dissipater comprises" and insert -- 1 further comprising a charge dissipater comprising --.

Column 11,
Line 24, after "by an electrical conductor" insert -- , --.

Signed and Sealed this

Seventh Day of May, 2002

*Attest:*

*Attesting Officer*

JAMES E. ROGAN
*Director of the United States Patent and Trademark Office*